US005840131A

United States Patent [19]

Yakashiro et al.

[11] Patent Number: 5,840,131

[45] Date of Patent: Nov. 24, 1998

[54] PROCESS FOR PRODUCING GRAIN-ORIENTED ELECTRICAL STEEL SHEET HAVING EXCELLENT GLASS FILM AND MAGNETIC PROPERTIES

[75] Inventors: Kenichi Yakashiro, Fukuoka; Hotaka Honma, Chiba; Maremizu Ishibashi, Fukuoka; Akira Sakaida, Fukuoka; Tomoji Kumano, Fukuoka; Koji Yamasaki, Fukuoka; Katsuro Kuroki, Fukuoka; Osamu Tanaka, Fukuoka, all of Japan

[73] Assignee: Nippon Steel Corporation, Tokyo, Japan

[21] Appl. No.: 836,593

[22] PCT Filed: Nov. 16, 1995

[86] PCT No.: PCT/JP95/02346

§ 371 Date: May 15, 1997

§ 102(e) Date: May 15, 1997

[87] PCT Pub. No.: WO96/15291

PCT Pub. Date: May 23, 1996

[30] Foreign Application Priority Data

| | | | |
|---|---|---|---|
| Nov. 16, 1994 | [JP] | Japan | 6-282292 |
| Nov. 16, 1994 | [JP] | Japan | 6-282293 |
| Nov. 16, 1994 | [JP] | Japan | 6-282294 |
| Dec. 13, 1994 | [JP] | Japan | 6-309162 |
| Dec. 13, 1994 | [JP] | Japan | 6-309163 |

[51] Int. Cl.[6] ..... H01F 1/18

[52] U.S. Cl. ..... 148/122; 148/113

[58] Field of Search ..... 148/113, 122

[56] References Cited

U.S. PATENT DOCUMENTS

| | | | |
|---|---|---|---|
| 3,582,407 | 6/1971 | Steger et al. . | |
| 3,841,925 | 10/1974 | Steger | 148/113 |
| 3,956,029 | 5/1976 | Yamamoto et al. | 148/113 |
| 4,168,189 | 9/1979 | Haselkorn | 148/113 |
| 4,249,966 | 2/1981 | Ichida et al. | 148/113 |
| 4,344,802 | 8/1982 | Haselkorn | 148/113 |
| 4,443,425 | 4/1984 | Sopp et al. | 148/113 |
| 4,543,134 | 9/1985 | Tanaka et al. | 148/113 |
| 4,740,251 | 4/1988 | Howe | 148/113 |
| 4,875,947 | 10/1989 | Nakayama et al. | 148/113 |
| 5,192,373 | 3/1993 | Wright et al. . | |
| 5,512,110 | 4/1996 | Yoshitomi et al. | 148/113 |
| 5,547,519 | 8/1996 | Murphy | 148/113 |

FOREIGN PATENT DOCUMENTS

| | | |
|---|---|---|
| 48-27055 | 8/1973 | Japan . |
| 2-267278 | 11/1990 | Japan . |
| 3-120376 | 5/1991 | Japan . |

*Primary Examiner*—John Sheehan
*Attorney, Agent, or Firm*—Kenyon & Kenyon

[57] ABSTRACT

A process for producing a grain-oriented electrical steel sheet excellent in the glass film and the magnetic properties by coating a steel sheet with an annealing separator, finish annealing the steel sheet, and baking an insulating coating agent, which comprises coating the steel sheet having been decarburization annealed with an annealing separator prepared by allowing 100 parts by weight of MgO to contain, in the course from the step of producing MgO to the stage of preparing a slurry in the step of coating the steel sheet with MgO, halogens selected from F, Cl, Br and I or compounds of the halogens in an amount of 0.015 to 0.120 part by weight in terms of F, Cl, Br and I, and finish annealing the steel sheet.

10 Claims, 4 Drawing Sheets

PROCESS FOR PRODUCING GRAIN-ORIENTED ELECTRICAL STEEL SHEET HAVING EXCELLENT GLASS FILM AND MAGNETIC PROPERTIES

TECHNICAL FIELD

The present invention relates to a process for producing a grain-oriented electrical steel sheet having excellent magnetic properties in which process an extremely uniform glass film having an excellent high tensile strength is formed over the entire surface of the coil in the final finish annealing step.

BACKGROUND ART

Usually in the production of a grain-oriented electrical steel sheet, a steel slab containing from 2.5 to 4.0% of Si is hot rolled, annealed, and cold rolled once or twice with intermediate annealing to give a steel sheet having a final thickness. Then, the steel sheet is subjected to decarburization annealing in a continuous annealing furnace in an atmosphere of $H_2$ or $H_2$ and $N_2$ while the $PH_2O/PH_2$ ratio is being controlled to achieve decarburization, primary recrystallization and formation of an oxide film mainly containing $SiO_2$. The steel sheet is subsequently coated with a slurry of an annealing separator mainly containing MgO with a coating roll, etc., dried, coiled, subjected to final finish annealing, and usually subjected to insulating coating treatment and heat flattening to give a final product.

Since (110)<001> crystal grains each having a <001> axis preferentially grow in the grain-oriented electrical steel sheet in secondary recrystallization at high temperature and migrate other crystals the growth of which is inhibited by AlN, MnS, etc. dispersed in the steel as inhibitors, the (110)<001> crystal grains are thought to grow preferentially.

In order to obtain a grain-oriented electrical steel sheet having excellent magnetic properties, therefore, the dispersion state of the inhibitors in the steel and stabilized control of them before secondary recrystallization during finish annealing are important. In particular, since the inhibitors are influenced by the stage of forming the glass film, and the thickness and the uniformity of the glass film in final finish annealing, the oxide film formed in decarburization annealing, the annealing separator, and the heat cycle and the atmosphere gas conditions in finish annealing are important.

The reaction for forming a glass film in finish annealing is a reaction for forming a forsterite film usually termed a glass film through a reaction of MgO in the annealing separator with an oxide film formed in decarburization annealing containing $SiO_2$ mainly ($2MgO+SiO_2 \rightarrow Mg_2SiO_4$). Moreover, when AlN is used as an inhibitor in the steel during the glass film formation, a film having a spinel structure is formed from $Al_2O_3$, MgO, $SiO_2$, etc. directly under the forsterite film. In the reaction for forming the glass film, in the pure system of MgO and $SiO_2$, the reaction does not take place unless the temperature is as high as near 1,600° C. Accordingly, important factors of the glass film formation reaction are the properties of the annealing separator such as the impurities, particle size, particle shape and activity of the main component MgO and additives as the reaction accelerators in addition to the properties of the oxide film (components, formation state), the conditions of finish annealing (heat cycle, atmosphere gas). How the glass film is formed uniformly from a low temperature in finish annealing becomes an important key to obtain an excellent glass film and good magnetic properties.

As described above, since production conditions up to decarburization annealing and finish annealing of the grain-oriented electrical steel sheet significantly influence the glass film and magnetic properties which are important in deciding the commodity value thereof, developing such production conditions matching the steel components has become an important problem in the production thereof.

As described above, MgO used in the step of forming a glass film is suspended in water to form a slurry together with a small amount of opotional additives incorporated as reaction accelerators, and applied to the steel sheet. The additives are usually oxides, S compounds, B compounds, and the like, which have been utilized as accelerators for forming the glass film.

MgO may become highly active depending on the production conditions thereof. A hydration reaction, $MgO \rightarrow Mg(OH)_2$, may then take place under some mixing and stirring conditions. Moisture is then brought within the coil (in sheet-to-sheet dew point is raised, and the atmosphere is made nonuniform in the longitudinal and in the width directions. Moreover, the types and amounts of the additives greatly influence the quality and amount of the glass film, depending on the presence of excessive oxygen and the dffects of reaction acceleration. As a result, nonuniform reactions may be caused during heating in finish annealing to form serious film defects such as scale, gas marks, pinholes and discoloration. As a means for solving the problem of high hydration, a procedure of using MgO prepared by firing at high temperature is generally adopted. For example, Japanese Patent Kokai Publication No. 62-156226 proposes a method for activating the top surface layer of MgO. According to the metod, MgO prepared by firing at high temperature is treated in a gas layer to form a hydration layer in the top surface layer alone of MgO. As a relult, the glass film and the magnetic properties are fairly improved. Furthermore, as a technique for improving the glass film with additives in the annealing separator, the present inventors proposes in Japanese Patent Kokai Publication No. 63-3022 a technique of adding 0.5 to 2.0 parts by weight of antimony sulfate containing given amounts of Sb, Sr, Ti and Zr chlorides to 100 parts by weight of MgO. The reaction for forming the glass film is improved by the technique, and excellent glass film properties and magnetic properties are obtained. Furthermore, Japanese Patent Kokai Publication No. 3-5820 proposes a method of adding 0.02 to 1.5 parts by weight of one or at least two chlorides of Sb, Sr, Ti and Zr to 100 parts by weight of MgO. The added compounds enrich $SiO_2$ in the components of the oxide film on the steel sheet surface and density the oxide film, and inhibit additional oxidation and promote reactions in finish annealing to give an excellent core loss. Furthermore, Japanese Patent Kokai Publication No. 3-120376 shows that addition of a chloride of metal selected from Na, K, Mg and Ca to MgO as a measure for improving the technique of adding antimony sulfate as a reaction accelerator achieves the effects of improving the magnetic properties without using antimony sulfate and sodium borate in combination.

Furthermore, Japanese Patent Kokai Publication No. 49-76719 discloses a technique for improving the quality of a grain-oriented electrical steel sheet by improving the finish annealing cycle. In the technique, a steel material containing up to 4% of Si, up to 0.06% of C, 0.005 to 0.100% of Sb and 0.01 to 0.05% of Al is used, and the technique aims at sufficiently developing secondary recrystallization in a temperature range of 800° to 900° C. in final finish annealing. That is, the steel material in the invention having a low secondary recrystallization temperature is held in a temperature range from 800° to 950° C. to effect sufficient secondary recrystallization, and subsequently subjected to purification annealing at temperature as high as at least 1,180° C. The steel sheet thus obtained shows improved magnetic properties.

However, in such conventional techniques, the glass film and the magnetic properties may become unstable sometimes, depending on decarburization annealing conditions and final finish annealing conditions. The techniques still remain unsatisfactory, and must be improved further.

SUMMARY OF THE INVENTION

The present invention provides a method of using a novel annealing separator and novel finish annealing conditions for improving glass film formation reactions of a grain-oriented electrical steel sheet, and an object of the present invention is to provide a production process for making the glass film glass film uniform and of high strength and improving the magnetic properties in the actual production, by using the method.

In a process for producing a grain-oriented electrical steel sheet including hot rolling a steel slab containing from 2.5 to 4.0% of Si as a steel component, cold rolling once or twice with intermediate annealing so that the steel sheet has a final thickness, decarburization annealing the steel sheet, coating the steel sheet with an annealing separator, finish annealing the steel sheet, and subjecting the steel sheet to insulating coating treatment, the present inventors have performed research on decarburization annealing, annealing separators, finish annealing conditions, etc. to improve glass film formation reactions.

As a result, they have discovered that the glass film formation reactions are extremely improved by coating the steel sheet with a slurry as an annealing separator containing elements of F, Cl, Br and I or compounds of these elements in an amount of 0.015 to 0.120 part by weight as a total amount of F, Cl, Br and I per 100 parts by weight of MgO, that more significant effects of improving the glass film and magnetic properties are produced when the halogen compounds contain a given amount of F and/or Cl or when the halogen compounds contain compounds of F and/or Cl with elements selected from Fe, Co, Mn, Cu and Ni in an amount of at least 50% as F and/or Cl based on the total halogens, and that as a result, a uniform glass film of high quality is formed over the entire surface of the coil and excellent magnetic properties are simultaneously obtained even when the coil is large. They have also found that the effects are further stabilized and improved by compositely adding from 0.01 to 0.50 part by weight of an alkali metal and/or alkaline earth metal compound together with from 0.015 to 0.120 part by weight of F, Cl, Br and I to the annealing separator, and that still more stabilized effects are obtained at the time of composite addition by controlling the physical values of base MgO, namely the CAA value, the particle size and the specific surface area. Moreover, a grain-oriented electrical steel sheet having a more excellent glass film and more excellent magnetic properties are obtained by the following finish annealing conditions when the annealing separator of the present invention is used: (1) in the heat cycle during heating from 850° to 1,150° C., the steel sheet is heated at an average heating rate of 12° C./hr, or the steel sheet is held at a constant temperature for 5 to 20 hours; and (2) the $PH_2O/PH_2$ ratio of the atmosphere gas during heating is set at up to 0.25, and/or the steel sheet is annealed in an atmosphere of $N_2$ and $H_2$ containing at least 30% of $H_2$ or in an atmosphere of $H_2$.

The present invention provides means for improving prior art related to decarburization annealing, an annealing separator and final finish annealing in the formation of a glass film and secondary recrystallization, and the aspects of the invention are as described below.

(1). A process for producing a grain-oriented electrical steel sheet excellent in the glass film and the magnetic properties by coating a steel sheet with an annealing separator, finish annealing the steel sheet, and baking an insulating coating agent, which comprises coating the steel sheet having been decarburization annealed with an annealing separator prepared by allowing 100 parts by weight of MgO to contain, in the course from the step of producing MgO to the stage of preparing a slurry in the step of coating the steel sheet with MgO, halogens selected from F, Cl, Br and I or compounds of the halogens in an amount of 0.015 to 0.120 part by weight in terms of F, Cl, Br and I, and finish annealing the steel sheet.

(2). The process for producing a grain-oriented electrical steel sheet excellent in the glass film and the magnetic properties according to (1), wherein the steel sheet having been decarburization annealed is coated with an annealing separator prepared by allowing 100 parts by weight of MgO to contain, in the course from the step of producing MgO to the stage of preparing a slurry in the step of coating the steel sheet with MgO, chlorides containing as constituent elements H, Li, Ba, V, Cr, Mo, Mn, Fe, Co, Ni, Cu, Ag, Zn, Cd, Al, Sn, Bi and O in an amount of 0.015 to 0.120 part by weight in terms of Cl, and the steel sheet is finish annealed.

(3). The process for producing a grain-oriented electrical steel sheet excellent in the glass film and the magnetic properties according to (1) to (2), wherein the steel sheet having been decarburization annealed is coated with an annealing separator prepared by adding and incorporating halogens or compounds thereof so that 100 parts by weight of MgO contains as halogens, in the course from the step of producing MgO to the stage of preparing a slurry in the step of coating the steel sheet with MgO, at least 0.005 part by weight of F and from 0.015 to 0.120 part by weight of F, Cl, Br and I in a total amount, and the steel sheet is finish annealed.

(4). The process for producing a grain-oriented electrical steel sheet excellent in the glass film and the magnetic properties according to (1) to (3), wherein in preparing the slurry of the annealing separator, halogens selected from F, Cl, Br and I or compounds thereof in a total amount of 0.015 to 0.120 part by weight in terms of F, Cl, Br and I and one or at least two alkali metal compounds and/or alkaline earth metal compounds excluding halogen compounds in an amount of 0.010 to 0.50 parts by weight are simultaneously added during preparing the slurry of the annealing separator.

(5). The process for producing a grain-oriented electrical steel sheet excellent in the glass film and the magnetic properties according to (1) to (4), wherein the halogen compounds to be added to or incorporated into the annealing separator contain one or at least two fluorides and/or chlorides of the constituent elements selected from at least Fe, Co, Mn, Cu and Ni in an amount of at least 50% in terms of F and/or Cl based on the total amount of halogens.

(6). The process for producing a grain-oriented electrical steel sheet excellent in the glass film and the magnetic properties according to (1) to (4), wherein MgO used as the annealing separator has a specific surface area of at least 10 $m^2/g$ and a CAA value of 40 to 250 sec, and at least 50% of the MgO has a particle size of up to 10 $\mu$m.

(7). The process for producing a grain-oriented electrical steel sheet excellent in the glass film and the magnetic properties according to (1) to (6), wherein (Fe, Mn)-O of the oxide film after decarburization annealing is in an amount of 0.015 to 0.30 g/m$^2$.

(8). The process for producing a grain-oriented electrical steel sheet excellent in the glass film and the magnetic properties according to (1) to (6), wherein the steel sheet is annealed by heating at an average heating rate of up to 12° C./hr in the course of raising the temperature from 850° to 1,150° C. during finish annealing.

(9). The process for producing a grain-oriented electrical steel sheet excellent in the glass film and the magnetic properties according to (1) to (6), wherein the steel sheet is held at a constant temperature for 5 to 20 hours in a holding temperature region of 850° to 1,150° C. in the course of raising the temperature during finish annealing.

(10). The process for producing a grain-oriented electrical steel sheet excellent in the glass film and the magnetic properties according to (1) to (6), wherein the steel sheet is annealed in an atmosphere gas having a $PH_2O/PH_2$ ratio of up to 0.25 in the course of raising the temperature to 800° C. during finish annealing.

(11). The process for producing a grain-oriented electrical steel sheet excellent in the glass film and the magnetic properties according to (1) to (6), wherein the atmosphere gas in the course of raising the temperature to 800° C. during finish annealing is a mixture gas of $N_2$ and $H_2$ containing at least 30% of $H_2$.

These methods can form a uniform high tensile glass film which is excellent in adhesion over the entire surface and entire width of a coil under wide production conditions in steel mill operations and which cannot be realized by prior art. Moreover, as a result of forming a uniform glass film at low temperature, inhibitors are stabilized up to high temperature, and absorption of nitrogen in steel and removal of inhibitors are appropriately conducted. Consequently, a grain-oriented electrical steel sheet showing a high magnetic flux density and a low core loss can be obtained.

THE MOST PREFERRED EMBODIMENT

Figure 1A:
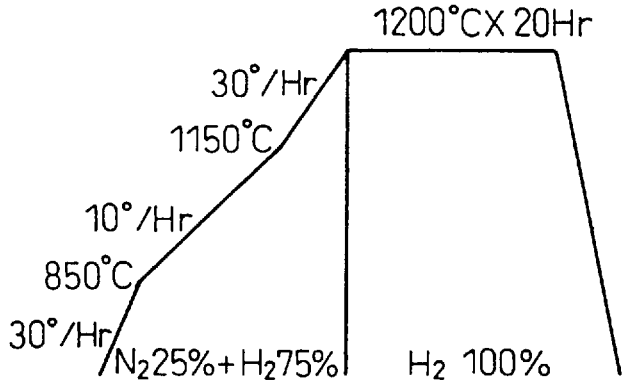
FIGS. 1A, 1B and 1C show the heat cycles and the atmosphere conditions of finish annealing in Example 3, and the heating rate changed under the conditions of (A), (B) and (C).

The present invention may be applied to any steel material so long as it may give a grain-oriented electrical steel sheet such as mentioned below: (1) a grain-oriented electrical steel sheet which is produced by the conventional double rolling process and in which MnS or MnSe is used as an inhibitor; (2) a grain-oriented electrical steel sheet which is produced by the single or double rolling process and in which MnS+AlN (e.g., as disclosed in Japanese Patent Kokoku Publication No. 40-15644 or U.S. Pat. No. 1,965,559) or Sb+MnSe are used as inhibitors; and (3) a grain-oriented electrical steel sheet (prepared by a new technique in recent years) the steel material of which contains up to 0.015% of S, 0.010 to 0.035% of Al, up to 0.012% of N and 0.05 to 0.45% of Mn without MnS as an important inhibitor not in a conventional manner (a steel material for low temperature slab heating), and which is prepared by decarburization annealing and nitriding so that inhibitors are adjusted (e.g., Japanese Patent Kokai Publication No. 59-56522).

These steel slab are hot rolled, cold rolled to have a final thickness, and decarburization annealed to form an oxide film containing $SiO_2$ mainly on the surface. The annealing separator of the present invention is subsequently applied to the steel sheet. Moreover, when the starting material is slab heated at a low temperature in (3), the annealing separator is applied after decarburization annealing and nitriding. A mixture obtained by using halogens selected from F, Cl, Br and I or compounds of the halogens in a total amount of 0.015 to 0.120 part by weight as F, Cl, Br and I per 100 parts by weight of MgO is used as the annealing separator. An alkali metal compound and/or alkaline earth metal compound is optionally added in an amount of 0.01 to 0.5 part by weight at this time. Preferred conditions of the MgO are as follows: the specific surface area is 10 m$^2$/g, at least 50% of MgO has a particle size of up to 10 $\mu$m, and the CAA value is from 40 to 250 sec. A slurry of such an annealing separator in pure water is prepared by uniform stirring and dispersion, and the steel sheet is coated with the slurry in a given amount with a coating roll, etc., and coiled.

The coiled steel sheet is subsequently subjected to final finish annealing at a temperature as high as 1,200° C. for a period of time as long as 20 hours to effect glass film formation, secondary recrystallization and purification. When halogens or compounds thereof are added to the annealing separator, a better glass film and better magnetic properties are obtained by specifying the heating conditions during heating in finish annealing. The heating conditions during heating in preferred finish annealing are either heating at an average heating rate of 12° C./hour in a temperature range of 850° to 1,150° C. or holding the steel sheet at a constant temperature in a range from 850° to 1,150° C. for 5 to 20 hours. At least 30% of $H_2$ containing gas or $H_2$ and $N_2$ mixture gas is employed as a preferred atmosphere condition during the heating. The coil thus treated and having a glass film formed thereon is rinsed with water in a continuous line to remove the annealing separator present excessively, lightly pickled with diluted sulfuric acid, coated with a tension-imparting type insulating coating agent containing colloidal silica and phosphoric acid salt, and subjected to heat flattening for the purpose of baking, leveling and stress relief annealing to give a final product.

In the grain-oriented electrical steel sheet, the stage, the amount and the state of forming a glass film by the series of the steps influence the precipitation state and the stability of AlN, MnS, etc. when AlN, MnS, etc. suffer oxidation and nitriding by the atmosphere gas. As a result, not only the quality of the glass film but also the magnetic properties of the product are influenced. When the annealing separator and the finish annealing conditions in the present invention are applied, such problems associated with prior art are solved immediately, and the glass film and the magnetic properties can be greatly improved.

Next, reasons for restriction of the present invention will be described.

As described above, the present invention can be applied to any steel materials which give grain-oriented electrical steel sheets such as described below: (1) a conventional grain-oriented electrical steel sheet obtained by using MnS or MnSe as an inhibitor and rolling twice; (2) a grain-oriented electrical steel sheet showing a high magnetic flux density obtained by using AlN+MnS or Sb+MnSe as inhibitors; and (3) a grain-oriented electrical steel sheet showing a high magnetic flux density obtained by using AlN as a main inhibitor (the inhibitor is adjusted by nitriding after decarburization). Since the appropriate range of the chemical components differ depending on the steel materials, the present invention does not restrict the chemical components of the steel.

In the steel materials in (1) and (2) mentioned above, the oxide film formed after decarburization annealing is coated with the annealing separator of the present invention. In the steel material in (3), the steel sheet having been nitrided is coated with the annealing separator of the present invention.

The present invention is firstly characterized by the composition of the annealing separator. The annealing separator used in the present invention contains halogens selected from F, Cl, Br and I or one or at least two compounds of these halogens in a total amount of 0.015 to 0.120 part by weight in terms of F, Cl, Br and I per 100 parts by weight of MgO which is used as the principal component of the annealing separator. F, Cl, Br and I or compounds of the halogens are added or mixed in the process for producing MgO or in the step of preparing the slurry of the annealing separator. The halogens or compounds exert an important action on the formation of a glass film and secondary recrystallization. That is, in the heating step in finish annealing, they drastically lower the melting point in the reaction of MgO with $SiO_2$ in the oxide film subsequent to decarburization annealing or nitriding. As a result, the glass film formation temperature is lowered further, and the reaction rate is markedly raised. Most of the halogen compounds added in the process for producing MgO or in the step of preparing the slurry are readily dissolved or finely dispersed in the water which is the slurry solvent.

In the steps from preparation to coating or drying of the slurry, the initial halogen compounds become the reaction products with MgO and other additives or substitution substances of the reaction products of the surface hydrate layer of MgO, and uniformly cover the surface of MgO and other additives or the oxide film of the steel sheet. As a result, the effects of uniformly forming the glass film over the entire surface of the steel sheet are achieved.

When the total amount of the halogens, F, Cl, Br and I, is less than 0.015 part by weight per 100 parts by weight of MgO, the effects of lowering the glass film formation reaction temperature, promoting the reaction and forming the glass film uniformly become insufficient. Accordingly, the lower limit of the total amount thereof is restricted. On the other hand, when the total amount exceeds 0.120 part by weight, the effects of early glass formation due to lowering the melting point are observed to be significant. However, the glass film thickness becomes nonuniform owing to excessive F, Cl, Br, I, etc. Moreover, in some extreme cases, excessive halogens etch and decompose the glass film to produce a glassless state. Accordingly, the upper limit of the total amount thereof is restricted.

A preferred total addition amount of F, Cl, Br and I is from 0.027 to 0.050 part by weight. When the total addition amount is in this range, the glass film hardly suffers the influence of decarburization annealing, final finish annealing and the conditions of MgO, and is extremely stabilized, whereby excellent magnetic properties of the steel sheet are obtained.

Figure 4:
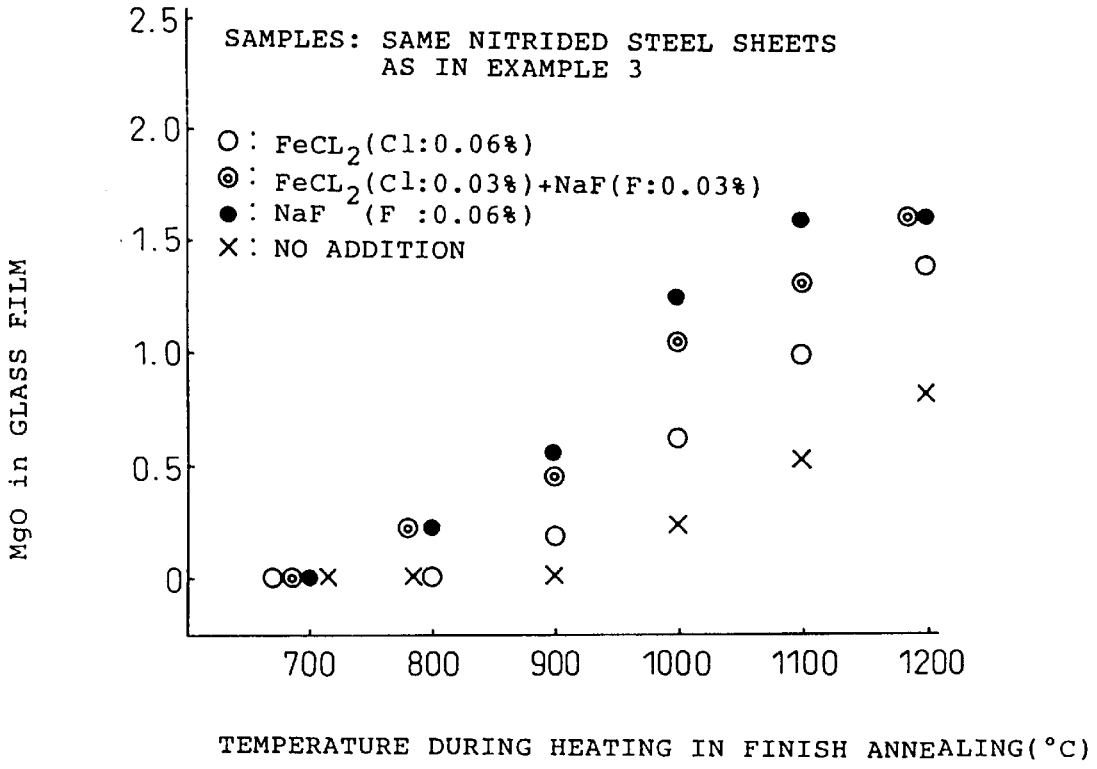
FIG. 4 is a graph showing the influence of halogens on reactions for forming a glass film in the heating step in finish annealing.

Next, the reasons for restricting the amount of F in the preferred range of the halogen content will be described. As claimed in claims 1 to 2, the total amount of F, Cl, Br and I is from 0.015 to 0.120 part by weight per 100 parts by weight of MgO. The F content in the total amount thereof is preferably from 0.005 to 0.120 part by weight. F or its compound in a trace amount greatly accelerates the $Mg_2SiO_4$ formation reaction in the process of forming the glass film. When the conditions of its use and the content are appropriately controlled, the effects of improving the glass film formation are greatly and stably achieved compared with Cl, Br and I or their compounds. FIG. 4 shows the influence of halogens on the glass film formation reaction in the course of heating in finish annealing. FIG. 4 shows that when a F compound is contained, the glass film formation begins on the low temperature side, and the growth rate is high. The reasons for this are thought to be as follows. F compounds are thermally stabilized compared with other compounds, and the degree of decomposition in a low temperature region during heating in finish annealing is small compared with other compounds. As a result, the F compounds maintain their effects up to a high temperature region necessary for the glass film formation, and thus act effectively. When the amount of F compounds is less than 0.005 part by weight, the degree of improvement in lowering the glass film formation temperature and accelerating the glass film formation is not significant. Although the role of F somewhat becomes minor under the condition that the addition amounts of Cl, Br and I are large, the F compounds produce effects at least equal to those of Cl+Br+I when their amount is less than 0.120 part by weight. However, when their amount becomes at least 0.120 part by weight, there arises the problem that a nonuniform glass film is formed or a glassless state is produced depending on the finish annealing conditions, in the same manner as in the case where the total amount of the halogens become excessive. The amount is, therefore, restricted.

Next, the constituent elements of the halogen compounds contained in or added to the annealing separator are H, Li, Ba, V, Cr, Mo, Mn, Fe, Co, Ni, Cu, Ag, Zn, Cd, Al, Sn, Bi and O. Examples of the halogen compounds include fluorides, chlorides, bromides, iodides, fluoric acid compounds, chloric acid compounds, bromic acid compounds, iodic acid compounds, perfluoric acid compounds, perchloric acid compounds, perbromic acid compounds and periodic acid compounds. However, the halogen compounds are not restricted to those mentioned above. Other compounds of F, Cl, Br and I or mixtures of these may also be used. When the amount of the halogens is intended to be adjusted in the process of producing MgO, it is satisfactory to add one or at least two halogens or compounds to and mixed with starting materials during reactions of forming $Mg(OH)_2$ or in the step of preparing $Mg(OH)_2$ slurry.

Since the added halogen compounds have a very good solubility or dispersibility in water, they are uniformly dissolved in the interior or adsorbed by the surface of the crystals of the starting material $Mg(OH)_2$ and distributed. The slurry of $Mg(OH)_2$ is then washed, dehydrated, molded, and fired in a furnace such as a batch furnace or rotary kiln while the firing conditions such as temperature, time, and the amount of starting materials to be charged and stirring conditions during firing are being controlled to give a product.

When an adjustment is made to the amount of halogens in the fired product of MgO at the stage of preparing a slurry in the step of coating, one or at least two compounds of F, Cl, Br and I containing H, Li, Ba, V, Cr, Mo, Mn, Fe, Co, Ni, Cu, Ag, Zn, Cd, Al, Sn, Bi, O, etc. are added in a total amount of 0.015 to 0.120 part by weight in terms of F, Cl and Br per 100 parts by weight of MgO. These compounds are stirred and dispersed together with other optionally incorporated additives to give a slurry. The compounds of F, Cl, Br and I with the elements mentioned above are very well dissolved or dispersed in the aqueous slurry, and uniformly disperse on the MgO particle surface, in other additives or on the oxide film of the steel sheet.

As described above, there are the following two procedures for adding the halogen compounds: (1) the halogen compounds are added in the step of producing MgO, and (2) the halogen compounds are added during preparation of the MgO slurry. The form of the annealing separator after applying to the steel sheet and drying varies depending on the conditions of adding to the raw material, dispersing therein and firing in the case of (1). The form is thought to vary in the case of (2), depending on the type and amount of the other added additives and stirring conditions. It is, therefore, difficult to determine the form of the halogen compounds. However, the forms are considered to be as follows: (1) the halogens or halogen compounds vaporized in the step of firing adhere to the surface of MgO to cover it in a state of MgO (F, Cl, Br, I); (2) the halogens or halogen compounds take a form of $Mg(OH)_{2-x}Cl_x$ as a substituent of the hydrate layer of the top surface layer of MgO; (3) the halogens or halogen compounds react with the main component MgO to form $Mg(F, Cl, Br, I)_2$; and (4) the initial halogen compounds diffuse and distribute on the surface of the MgO product or within MgO without changing their form. These halogen compounds produce effects of significantly improving the reactivity of MgO with the $SiO_2$ layer in finish annealing.

A preferred condition of adding the halogen compounds is that the halogen compounds to be added contain one or at least two fluorides and/or chlorides of the constituent elements of the halogen compounds to be added which elements are selected from at least Fe, Co, Mn, Cu and Ni in an amount of at least 50% in terms of F and/or Cl based on the total halogens. Fluorides and chlorides of Fe, Co, Mn, Cu, Ni, etc. produce effects of greatly improving the glass film compared with fluorides and chlorides of other metal elements. The fluorides and chlorides of Fe, Co, Mn, Cu, Ni, etc. are considered to be converted to hydroxides, oxides, oxy compounds, etc. at the time of their dissolution into the slurry or decomposition during finish annealing to produce new composite effects.

Next, the addition amount of the alkali metal and/or alkaline earth metal compounds which are added together with the halogen compounds is from 0.01 to 0.5 parts by weight based on the total amount of the halogen compounds in terms of F, Cl, Br and I, namely 0.015 to 0.120 parts by weight. In the present invention, the alkali metal or alkaline earth metals play an important role of stabilizing the halogen compounds from the time when they are added to the slurry to the time when they are heated to a high temperature region for finish annealing. That is, the added halogen compounds take the form of (1) to (4) when there are neither the alkali metal compounds nor alkaline earth metal compounds, and the states differ depending on the preparation conditions. The halogen compounds cannot produce their effects sufficiently unless they are maintained stably up to the stage of the glass film formation in the course of slurry preparation→coating drying→finish annealing. Since the alkali metal and the alkaline earth metal compounds have a strong affinity with the halogens, and selectively combine therewith from slurry preparation stage to coating drying stage in accordance with the solubility to coat the MgO particles, other additives or the oxide film of the steel sheet uniformly and to stabilize the halogen compounds. Moreover, the alkali or alkali metal compounds themselves produce the effects of lowering the melting point to some degree. As a result, the composite action effectively produces glass film formation effects to give a uniform glass film of good quality, and heightens the effects of improving the magnetic properties.

Preferred examples of the alkali metal and the alkaline earth metal compounds are water-soluble substances such as hydroxides, borates, sulfates, nitrates and silicates of Li, Na, K, Ca, Ba, Mg, and the like. When the added amount is less than 0.01 part by weight, the auxiliary effects of stabilizing and lowering the melting point of the halogen compounds are not produced. On the other hand, when the addition amount exceeds 0.5 part by weight, excessive alkali metals and alkaline earth metals cause etching and a reduction reaction at high temperature in finish annealing to create problems such as formation of pinhole-like, gas marks, a nonuniform film, and the like. Accordingly, the addition amount is restricted.

The MgO to which such halogen compounds, and alkali metal or alkaline earth metal compounds, are to be added has a CAA value of 40 to 250 sec, a specific surface area of at least 10 $m^2/g$, and a particle size in such a manner that at least 50% of MgO has a particle size of up to 10 $\mu$m. In the glass film formation reaction utilizing the halogen compounds according to the present invention, since the effects of improving the reaction is significant, the steel sheet is difficult to suffer additional oxidation caused by moisture, oxygen, etc. in the atmosphere gas in the step of finish annealing. On the other hand, the glass formation reaction does not require so much moisture from MgO and the atmosphere gas as conventional annealing separators require. As a result, stabilized glass film formation can be realized over the entire surface of the coil in an atmosphere of finish annealing ranging widely from a dry one to a wet one. When MgO has a CAA value of less than 40 sec, industrial stabilized control of the hydrate moisture becomes difficult in the step of preparing the MgO slurry. As a result, the hydrate moisture unavoidably becomes unstabilized and extremely increases. Consequently, improvement of the stability of the glass film and the magnetic properties becomes difficult even when the annealing separator of the present invention is used. On the other hand, when MgO has a CAA value exceeding 250 sec, the MgO slurry unpreferably lower its adhesion to the steel sheet during applying the slurry thereto, and the applying operation unpreferably becomes difficult owing to a decrease in the slurry viscosity though the hydrate moisture is stabilized. In the technique of adding the halogens or these compounds according to the present invention, such problems are solved. As a result, good reactivity and a good applying operation can be obtained, and an excellent glass film and excellent magnetic properties can be realized when the MgO has a CAA value of 40 to 250 sec.

At least 50% of the entire MgO particles are MgO particles having a particle size of up to 10 $\mu$m. Good product properties can be obtained under wide particle size conditions compared with conventional annealing separators. The situation of the particle size is thus similar to that of the CAA value mentioned above. When MgO particles having a particle size of up to 10 $\mu$m are less than 50% of the entire MgO particles, the contact area between the MgO particles and the steel sheet is lowered and the reactivity of the MgO particles is also lowered. As a result, even when the annealing separator of the present invention in which halogen compounds are contained is used, the film properties are deteriorated to some degree.

For the same reasons as mentioned above, the conditions for use of the specific surface area of MgO is alleviated compared with conventional annealing separators. However, when the specific surface area is up to 10 $m^2/g$, the reactivity of MgO is extremely lowered, and problems as to the thickness, uniformity, adhesion, and the like of the glass film tend to arise. Accordingly, the lower limit of the specific surface area is restricted. A preferred range of the specific surface area is at least 15 $g/m^2$. A good glass film and good magnetic properties are obtained regardless of the conditions, etc. of finish annealing so long as the specific surface area of MgO is in this range.

The specific surface area is a surface area obtained from the adsorption amount (single layer) of nitrogen adsorbed by a given amount of a sample powder. The procedure for obtaining it is termed gas layer adsorption or liquid nitrogen physical adsorption, and represented by BET.

Furthermore, in the present invention, the amount of the oxide film component as (Fe, Mn)—O is defined to be from 0.015 to 0.30 $g/m^2$. The (Fe, Mn)—O component exists mainly in forms such as $Fe_2SiO_4$, $FeSiO_3$, $Mn_2SiO_4$ and $MnSiO_3$ on the surface layer of the steel sheet. The (Fe, Mn)—O type oxide has effects on accelerating the forsterite film formation reaction to some degree, and influences the permeability of the oxide film for the atmosphere gas. These contribute to improvement of the reactivity between MgO and $SiO_2$ synergistically with chlorides, alkali metals, alkaline earth metals, and the like according to the present invention. When the total amount of these in the oxide film, which amount is obtained by quantitative analysis of Fe and Mn (namely, (Fe, Mn)—O amount), is less than 0.015 $g/m^2$, the effects of sufficiently improving the stability of the glass film are not sufficiently obtained, even by the use of the technique of adding chlorides, and alkali and/or alkali metal compounds according to the present invention. On the other hand, when the amount exceeds 0.30 $g/m^2$, there arises the problem that the oxide film itself becomes porous, and the sealing properties are deteriorated. Moreover, addition of the chlorides, and alkali and/or alkaline earth metals according to the present invention may form as glass film defects specific to peroxidation pinhole-like spots with metallic luster, scale, gas marks, etc., or may accelerate inhibitor removal owing to the peroxidation phenomenon to lower the magnetic flux density and produce a poor core loss. Accordingly, the amount is restricted.

Next, reasons for restricting the heat cycle and the atmosphere gas as preferred finish annealing conditions according to the present invention will be described.

Firstly, the average heating rate in a temperature range from 850° to 1,150° C. during heating is defined to be up to 12° C./hr. The lower limit of the temperature range is defined to be 850° C. because the glass film is not formed substantially at temperature up to 850° C., and because the surface oxide film is reduced and adverse effects are exerted on the glass film formation when the steel sheet is heated at a low rate in a low temperature region and held at low temperature over a long period of time. As a procedure for raising the temperature from 850° to 1,150° C., the steel sheet may be heated at an average rate of up to 12° C./hr, or it may be held at a given temperature in the temperature region during heating. When the average heating rate exceeds 12° C./hr, a time for the growth of the glass film is not sufficient, and effects of the improvement is not achieved. When the steel sheet is held at a given temperature, holding it at the temperature for 5 to 20 hr produces excellent effects. The conditions are preferred particularly when a uniform glass film and uniform magnetic properties of a large coil are to be obtained. Holding the coil at a constant temperature during heating makes the temperature difference between the inner and the outer periphery of the coil more uniform and also makes the sheet-to-sheet atmosphere homogeneous, and uniformly forms the glass film at low temperature. Accordingly, more significant effects of improving the steel sheet are produced. Moreover, a tight glass film layer formed during finish annealing inhibits invasion of nitrogen from the atmosphere in a high temperature region, and suppresses inhibitor removal on the other hand. As a result, the inhibitors are kept stabilized up to the stage of secondary recrystallization, and the magnetic properties are improved further. Particularly when the procedure is applied to a steel material in which AlN is used as an inhibitor, the effects of controlling the heating rate are significantly achieved.

A preferred atmosphere gas for finish annealing should firstly have a $PH_2O/PH_2$ ratio of up to 0.25 at temperature of up to 800° C. As described above, the glass film is formed in a high temperature region of at least 850° C. As a result, when the oxidation degree is high during heating, additional oxidation prior to the glass film formation is caused. Although the annealing separator of the present invention significantly inhibits the additional oxidation, there is a limitation on the effect when the $PH_2O/PH_2$ ratio is at least 0.25. As a result, defects such as pinholl-like spots, scale and gas marks are likely to be formed. Moreover, when additional oxidation is caused, the structure of the oxide film becomes porous, and consequently nitriding is caused, or removal of an inhibitor is accelerated to deteriorate the magnetic properties. When the $PH_2O/PH_2$ ratio is up to 0.25, the glass film is stably formed owing to the use of the annealing separator of the present invention. The oxidation degree of the atmosphere during heating is controlled by controlling the hydration moisture of MgO mentioned above, the coating amount of the annealing separator, the coiling pressure, the amount of the atmosphere gas, the gas components, and the like.

The content of $H_2$ as a component of the atmosphere gas is preferably at least 30%. $N_2$, $N_2+H_2$ or other inert gas is usually used as the atmosphere gas during heating. When the annealing separator of the present invention is used, effects of greatly improving the glass film and the magnetic properties are achieved owing to the use of the gas component. Firstly, the oxidation degree among steel sheets are lowered and additional oxidation is inhibited during heating to make the reaction acceleration effects, which are produced by the halogen compounds, more uniform. Secondly, additional nitriding is inhibited during heating, and the inhibitors are highly stabilized. As a result, the glass film and the magnetic properties appear to be improved more surely. An atmosphere containing at least 75% of $H_2$ is a preferred atmosphere condition. When the $H_2$ content is in the range, a uniform glass film of good quality is formed, and the magnetic properties are improved further. When the $H_2$ content is less than 30%, additional oxidation may be produced depending on the conditions of MgO, and non-uniform glass film formation portions may be observed here and there on the coil or variation in magnetic properties may be observed depending on the location in the coil.

EXAMPLE

Example 1

A steel ingot containing, based on weight, 0.080% of C, 3.25% of Si, 0.070% of Mn, 0.024% of S, 0.028% of Al, 0.0078% of N, 0.080% of Cu, 0.06% of Sn and the balance Fe and unavoidable impurities was hot rolled to give a hot rolled steel sheet having a thickness of 2.3 mm. The steel sheet was annealed at 1,120° C., pickled, and cold rolled to give a cold rolled steel sheet having a thickness of 0.23 mm. The cold rolled steel sheet was then decarburization annealed at 850° C. for 100 sec in a continuous line in an atmosphere containing 25% of $N_2$ and 75% of $H_2$ and having a dew point of 65° C. The decarburization annealed steel sheet was coated with an annealing separator (dried weight: 6 g/m$^2$) containing 5 parts by weight of $TiO_2$ and 100 parts by weight of MgO obtained by incorporating halogen compounds during preparing $Mg(OH)_2$ in the process of producing MgO and firing, and having chemical components as shown in Table 1, dried, coiled, and final finish annealed at 1,200° C. for 20 hours. Excessive MgO was removed in the continuous line. The steel sheet was then lightly pickled, coated with an insulting coating agent containing 70 ml of 30% colloidal silica and 50 ml of 50% aluminum phosphate, in an amount of 5 g/m$^2$ as dried and baked, and baked at 850° C. for 30 sec to give a final product. Table 2 shows the glass film properties and the magnetic properties of the steel sheet in the test.

TABLE 1

| | Halogens in MgO (%) | | | | Total amount of halogens |
|---|---|---|---|---|---|
| | F | Cl | Br | I | (%) |
| Ex. 1 | 0.030 | 0.010 | — | — | 0.040 |
| Ex. 2 | 0.060 | 0.010 | — | — | 0.070 |
| Ex. 3 | 0.010 | 0.030 | — | — | 0.040 |
| Ex. 4 | 0.010 | 0.060 | — | — | 0.070 |
| Ex. 5 | 0.010 | 0.010 | 0.040 | — | 0.060 |
| Ex. 6 | 0.020 | 0.020 | 0.020 | — | 0.060 |
| Ex. 7 | 0.020 | 0.020 | | 0.020 | 0.060 |
| Ex. 8 | 0.060 | 0.005 | — | — | 0.065 |
| Comp. Ex. 1 | 0.005 | 0.005 | — | — | 0.010 |
| Comp. Ex. 2 | 0.060 | 0.070 | | | 0.130 |
| Comp. Ex. 3 | 0.150 | 0.005 | | | 0.155 |
| Comp. Ex. 4 | 0.040 | 0.040 | 0.040 | 0.040 | 0.160 |

TABLE 2

| | | Properties of glass film | | Magnetic properties | |
|---|---|---|---|---|---|
| | | Film | | | |
| | State of glass film formation | tension (kg/mm$^2$) | Adhesion* | $B_8$ (T) | $W_{17/50}$ (W/kg) |
| Ex. 1 | uniform and lustrous glass film | 0.50 | ⊕ | 1.938 | 0.81 |
| Ex. 2 | thick, uniform and lustrous glass film | 0.60 | ⊕ | 1.950 | 0.78 |
| Ex. 3 | uniform and lustrous glass film | 0.45 | ○ | 1.933 | 0.85 |
| Ex. 4 | uniform and lustrous glass film | 0.48 | ⊕ | 1.942 | 0.82 |
| Ex. 5 | uniform and lustrous glass film | 0.47 | ⊕ | 1.945 | 0.83 |
| Ex. 6 | uniform and lustrous glass film | 0.53 | ⊕ | 1.943 | 0.80 |
| Ex. 7 | uniform and lustrous glass film | 0.45 | ○ | 1.940 | 0.84 |
| Ex. 8 | thick, uniform and lustrous glass film | 0.63 | ⊕ | 1.955 | 0.77 |
| Comp. Ex. 1 | very thin, base steel seen through glass film | 0.12 | X | 1.890 | 0.94 |
| Comp. Ex. 2 | many uneven portions, many scale-like defects though thick | 0.30 | Δ | 1.922 | 0.88 |
| Comp. Ex. 3 | many gas mark-like uneven portions, many scale-like defects | 0.20 | X | 1.928 | 0.89 |
| Comp. Ex. 4 | many pinhole-like, scale-like defects | 0.15 | Δ | 1.910 | 0.92 |

Note:
*A steel sheet coated with the insulating coating was bent to form a curvature (diameter of 15 mm), and the adhesion was evaluated as follows: ⊕: no peeling, ○: slight peeling, Δ: somewhat much peeling, and X: much peeling.

As a result of the test, all the glass films formed in examples by the use of MgO containing halogens were found to be uniform over the entire surfaces of the steel sheets. Moreover, the steel sheets showed very good magnetic properties. In particular, when steel sheets were obtained by using MgO containing fluorine as a main halogen showed extremely excellent glass films and magnetic properties. On the other hand, the comparative steel sheet obtained by the use of MgO containing halogens in a decreased amount had an extremely thin glass film which had poor adhesion, and showed very poor results with regard to a magnetic flux density and a core loss. Furthermore, those steel sheets obtained by the use of MgO having a high halogen content had glass films which had many uneven portions and many pinhole-like and scale-like defects locally and which showed poor adhesion. Furthermore, in the comparative examples, the steel sheets also exhibited significantly poor magnetic properties compared with the steel sheets of the present invention.

Example 2

A steel ingot containing, based on weight, 0.078% of C, 3.15% of Si, 0.068% of Mn, 0.024% of S, 0.030% of Al, 0.0078% of N, 0.080% of Cu, 0.07% of Sn and the balance Fe and unavoidable impurities was hot rolled to give a hot rolled steel sheet having a thickness of 2.3 mm. The steel sheet was annealed at 1,120° C., pickled, and cold rolled to give a cold rolled steel sheet having a final thickness of 0.23 mm. The cold rolled steel sheet was then decarburization annealed at 850° C. for 110 sec in a continuous line in an atmosphere containing 25% of $N_2$ and 75% of $H_2$ and having a dew point of 67° C. The decarburization annealed steel sheet was coated with an annealing separator (dried weight: 7 g/m$^2$) obtained by adding halogen compounds as shown in Table 3 to a slurry of 5 parts by weight of $TiO_2$ and 100 parts by weight of MgO which had a CAA value of 150 sec and a specific surface area of 18 m$^2$/g and 80% of which had a particle size up to 10 $\mu$m, dried, coiled, and final finish annealed and subjected to insulating coating treatment in the same manner as in Example 1 to give a final product. Table 4 shows the glass film properties and the magnetic properties of the steel sheet in the test.

TABLE 3

| | Added halogen compounds and their amounts (as parts by weight of halogens) | | | | | | Total amount of halogens (parts by weight) |
|---|---|---|---|---|---|---|---|
| | F | | Cl | | Br | I | |
| Ex. 1 | — | | $ZnCl_2$ | 0.03 | — | — | 0.03 |
| Ex. 2 | — | | $ZnCl_2$ | 0.06 | — | — | 0.06 |
| Ex. 3 | — | | $FeCl_2$ | 0.03 | — | — | 0.03 |
| Ex. 4 | — | | $FeCl_2$ | 0.06 | — | — | 0.06 |
| Ex. 5 | — | | $MnCl_2$ | 0.03 | — | — | 0.03 |
| Ex. 6 | — | | $MnCl_2$ | 0.06 | — | — | 0.06 |
| Ex. 7 | NaF | 0.04 | $MnCl_2$ | 0.03 | — | — | 0.07 |
| Ex. 8 | $CaF_2$ | 0.04 | $FeCl_2$ | 0.03 | — | — | 0.07 |
| Ex. 9 | $MgF_2$ | 0.04 | $CoCl_2$ | 0.03 | AgBr 0.02 | — | 0.09 |
| Ex. 10 | $MgF_2$ | 0.04 | $AlCl_3$ | 0.03 | — | $FeI_2$ 0.02 | 0.09 |
| Comp. Ex. 1 | — | | $ZnCl_2$ | 0.01 | — | — | 0.01 |
| Comp. Ex. 2 | — | | $FeCl_2$ | 0.20 | — | — | 0.20 |
| Comp. Ex. 3 | $CaF_2$ | 0.10 | $FeCl_2$ | 0.06 | — | — | 0.16 |
| Comp. Ex. 4 | NaF | 0.04 | $MnCl_2$ | 0.03 | AgBr 0.10 | — | 0.17 |

Note:
*Impurities of base MgO: F: 0.0030, Cl: 0.002, Br: trace, I: trace

TABLE 4

| | | Properties of glass film | | Magnetic properties | |
|---|---|---|---|---|---|
| | | Film | | | |
| | State of glass film formation | tension ($kg/mm^2$) | Adhesion* | $B_8$ (T) | $W_{17/50}$ (W/kg) |
| Ex. 1 | thin to some degree, but uniform and good | 0.35 | ○ | 1.928 | 0.84 |
| Ex. 2 | uniform and good over entire steel sheet surface | 0.48 | ⊕ | 1.937 | 0.83 |
| Ex. 3 | thick, very uniform and good; lustrous | 0.57 | ⊕ | 1.955 | 0.80 |
| Ex. 4 | thick, very uniform and good; lustrous | 0.68 | ⊕ | 1.950 | 0.79 |
| Ex. 5 | thick, very uniform and good; lustrous | 0.50 | ⊕ | 1.953 | 0.81 |
| Ex. 6 | thick, very uniform and good; lustrous | 0.63 | ⊕ | 1.955 | 0.78 |
| Ex. 7 | uniform and lustrous glass film | 0.66 | ⊕ | 1.945 | 0.80 |
| Ex. 8 | thick, very uniform and good; lustrous | 0.65 | ⊕ | 1.960 | 0.77 |
| Ex. 9 | thick, very uniform and good; lustrous | 0.55 | ⊕ | 1.948 | 0.78 |
| Ex. 10 | uniform and good; lustrous | 0.60 | ⊕ | 1.950 | 0.80 |
| Comp. Ex. 1 | very thin, base steel being entirely exposed | 0.15 | X | 1.878 | 0.96 |
| Comp. Ex. 2 | surface being dark gray, very thin | 0.12 | X | 1.903 | 0.92 |
| Comp. Ex. 3 | many scale-like uneven portions, locally thin | 0.18 | Δ | 1.913 | 0.92 |
| Comp. Ex. 4 | many scale-like uneven portions, locally thin | 0.20 | Δ | 1.920 | 0.88 |

As a result of the test, a uniform and lustrous glass film was formed whenever halogen compounds of the present invention were added to the annealing separating agent, and the magnetic properties were significantly improved. In particular, when Fe, Mn and Co compounds were added as Cl sources, the steel sheets thus obtained exhibited significantly improved glass film properties and magnetic properties compared with the steel sheets prepared by adding other compounds. Furthermore, when F and Cl compounds were simultaneously added as halogen substances, the steel sheets thus obtained had glass films excellent in uniformity and luster, and tended to have stabilized magnetic properties. On the other hand, when the halogen amounts were small, the steel sheets thus obtained each had a thin glass film and showed very poor magnetic properties. Moreover, when the halogen amounts were excessive compared with those in the present invention, the steel sheets thus obtained each had a nonuniform glass film and glassless portions, and showed significantly poor magnetic properties compared with the steel sheets of the present invention.

Example 3

Figure 1B:
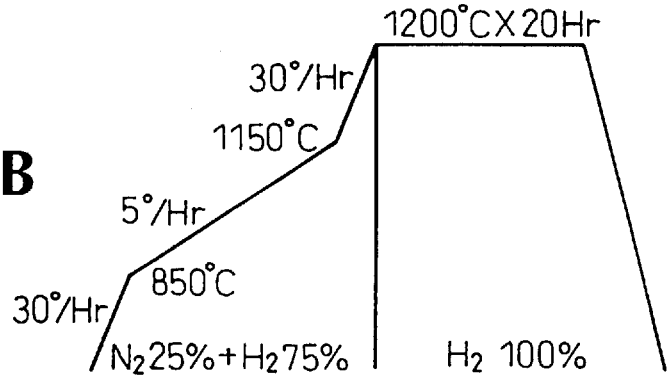
Figure 1C:
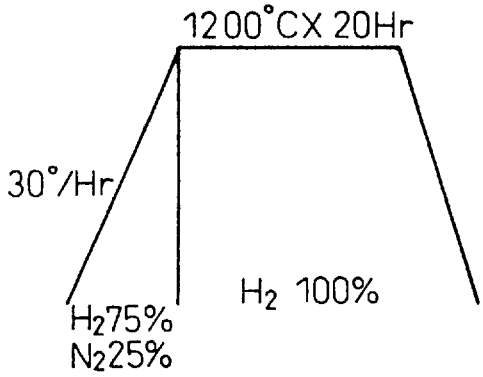

A steel ingot containing, based on weight, 0.055% of C, 3.30% of Si, 0.130% of Mn, 0.0080% of S, 0.030% of Al, 0.0072% of N, 0.04% of Sn, and the balance Fe and unavoidable impurities was heated to 1,150° C., and hot rolled to give a hot rolled steel sheet having a thickness of 2.3 mm. The steel sheet was annealed at 1,120° C., and cold rolled to have a final thickness of 0.23 mm. The cold rolled steel sheet was then decarburization annealed at 840° C. for 110 sec in a continuous line in an atmosphere containing 25% of $N_2$ and 75% of $H_2$ and having a dew point of 67° C., and annealed at 750° C. for 30 sec in a dry atmosphere containing 25% of $N_2$, 75% of $H_2$ and $NH_3$ to have a nitrogen content in steel of 200 ppm. The annealed steel sheet was subsequently coated with the slurry of an annealing separator (dried weight: 6 $g/m^2$) obtained by adding halogen compounds, and an alkali metal compound or alkaline earth metal compound to 5 parts by weight of $TiO_2$ and 100 parts by weight of MgO as shown in Table 5, dried, and coiled. The steel sheet was then finish annealed while the heating rate was being changed as shown in FIG. 1, and subjected to baking treatment with the insulating coating agent in the same manner as in Example 1 to give a final product. Table 6 shows the glass film properties and the magnetic properties of the steel sheet in the test.

TABLE 5

| | Type of halogen compounds and their amounts (parts by weight as halogens) | | | Alkali metal or alkaline earth metal compound (parts by weight) | Heat cycle of finish annealing |
|---|---|---|---|---|---|
| Ex. 1 | $MgF_2$ | 0.03/$CuCl_2$ | 0.04 | — | FIG. 1 (A) |
| Ex. 2 | LiF | 0.03/$NiCl_2$ | 0.04 | — | FIG. 1 (A) |
| Ex. 3 | $MgF_2$ | 0.03/$FeCl_2$ | 0.04 | — | FIG. 1 (A) |
| Ex. 4 | $MgF_2$ | 0.03/$FeCl_2$ | 0.04 | $Li_2B_4O_7$ 0.1 | FIG. 1 (A) |
| Ex. 5 | $MgF_2$ | 0.03/$FeCl_2$ | 0.04 | $kB_4O_7$ 0.2 + $CaB_4O_7$ 0.2 | FIG. 1 (A) |
| Comp. Ex. 1 | — | | | $Li_2B_4O_7$ 0.1 | FIG. 1 (A) |
| Ex. 6 | $MgF_2$ | 0.03/$FeCl_2$ | 0.04 | — | FIG. 1 (B) |
| Ex. 7 | $MgF_2$ | 0.03/$FeCl_2$ | 0.04 | $Li_2B_4O_7$ 0.1 | FIG. 1 (B) |
| Ex. 8 | $MgF_2$ | 0.03/$FeCl_2$ | 0.04 | $kB_4O_7$ 0.2 + $CaB_4O_7$ 0.2 | FIG. 1 (B) |
| Comp. Ex. 2 | — | | | $Li_2B_4O_7$ 0.1 | FIG. 1 (B) |
| Ex. 9 | $MgF_2$ | 0.03/$FeCl_2$ | 0.04 | — | FIG. 1 (C) |
| Ex. 10 | $MgF_2$ | 0.03/$FeCl_2$ | 0.04 | $Li_2B_4O_7$ 0.1 | FIG. 1 (C) |
| Ex. 11 | $MgF_2$ | 0.03/$FeCl_2$ | 0.04 | $kB_4O_7$ 0.2 + $CaB_4O_7$ 0.2 | FIG. 1 (C) |
| Comp. Ex. 3 | — | | | $Li_2B_4O_7$ 0.1 | FIG. 1 (C) |

Note:
Impurities of base MgO: F: 0.0030, Cl: 0.002, Br: trace, I: trace

TABLE 6

| | State of glass film formation | Properties of glass film: Film tension (kg/mm$^2$) | Properties of glass film: Adhesion* | Magnetic properties: $B_8$ (T) | Magnetic properties: $W_{17/50}$ (W/kg) |
|---|---|---|---|---|---|
| Ex. 1 | uniform and lustrous, good | 0.52 | ⊕ | 1.939 | 0.82 |
| Ex. 2 | uniform and lustrous, good | 0.55 | ⊕ | 1.940 | 0.82 |
| Ex. 3 | uniform and thick, lustrous and extremely good | 0.60 | ⊕ | 1.950 | 0.79 |
| Ex. 4 | uniform and thick, lustrous and extremely good | 0.65 | ⊕ | 1.956 | 0.76 |
| Ex. 5 | uniform and thick, lustrous and extremely good | 0.75 | ⊕ | 1.960 | 0.74 |
| Comp. Ex. 1 | very thin, without luster, and with uneven portions | 0.21 | X | 1.888 | 0.96 |
| Ex. 6 | uniform and thick, lustrous and extremely good | 0.62 | ⊕ | 1.950 | 0.76 |
| Ex. 7 | uniform and thick, lustrous and extremely good | 0.78 | ⊕ | 1.965 | 0.75 |
| Ex. 8 | uniform and thick, lustrous and extremely good | 0.78 | ⊕ | 1.968 | 0.72 |
| Comp. Ex. 2 | very thin, base steel being seen through glass film | 0.17 | X | 1.890 | 0.94 |
| Ex. 9 | uniform and thick, lustrous and extremely good | 0.53 | ⊕ | 1.935 | 0.84 |
| Ex. 10 | uniform and thick, lustrous and extremely good | 0.57 | ⊕ | 1.939 | 0.81 |
| Ex. 11 | uniform and thick, lustrous and extremely good | 0.58 | ⊕ | 1.945 | 0.80 |
| Comp. Ex. 3 | very thin, many uneven portions | 0.22 | X | 1.879 | 0.95 |

As a result of the test, it has been found that when the annealing separators of the present invention were used, steel sheets having good magnetic properties were always obtained owing to the formation of uniform and good glass films, and that particularly when the finish annealing conditions were slow heating cycles as shown in FIG. 1 (A) and (B), the steel sheets thus obtained each had a glass film with extremely good properties, and showed extremely good magnetic properties. Moreover, in the experiment, when $FeCl_2$ was used as a halogen compound, or $FeCl_2$ and an alkali metal or alkaline earth metal compound were simultaneously added, the steel sheet thus obtained had a glass film with improved properties and tended to show improved magnetic properties to some degree. On the other hand, in comparative examples where the annealing separator contained no halogen compound the steel sheets thus obtained each had a glass film formed in an extremely poor state and showed extremely poor magnetic properties compared with the steel sheets of the invention, regardless of the finish annealing conditions.

Example 4

Figure 2A:
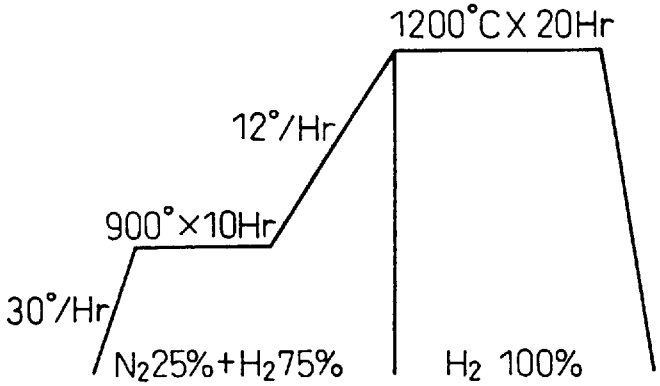
FIGS. 2A, 2B and 2C show the heat cycles and the atmosphere conditions of finish annealing in Example 4, and the heating rate changed under the conditions of (A), (B) and (C).
Figure 2B:
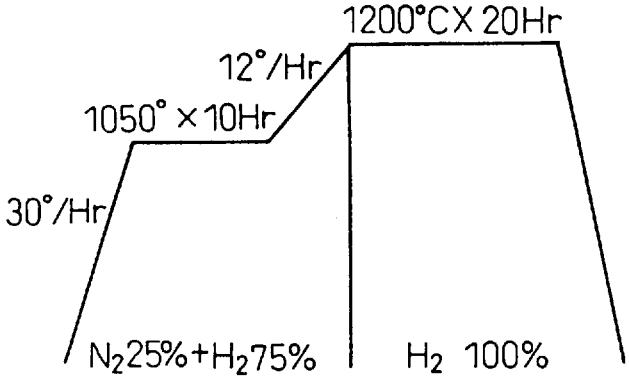
Figure 2C:
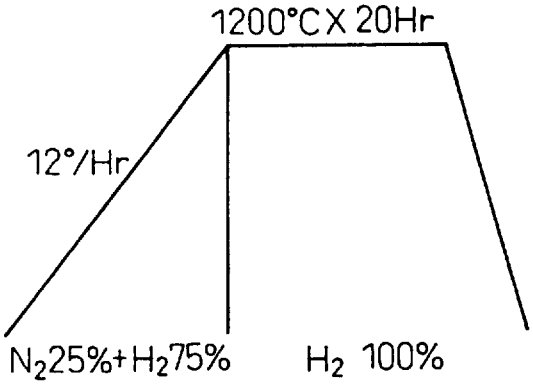

A steel ingot containing, based on weight, 0.058% of C, 3.35% of Si, 0.140% of Mn, 0.0075% of S, 0.030% of Al, 0.0075% of N, 0.05% of Sn, and the balance Fe and unavoidable impurities was heated to 1,150° C., and hot rolled to give a hot rolled steel sheet having a thickness of 2.3 mm. The steel sheet was annealed at 1,120° C., and cold rolled to give a cold rolled steel sheet having a final thickness of 0.23 mm. The cold rolled steel sheet was then decarburization annealed at 840° C. for 110 sec in a continuous line in an atmosphere containing 25% of $N_2$ and 75% of $H_2$ and having a dew point of 67° C., and annealed at 750° C. for 30 sec in a dry atmosphere containing 25% of $N_2$, 75% of $H_2$ and $NH_3$ to have a nitrogen content in steel of 180 ppm. The annealed steel sheet was subsequently coated with a slurry in an amount of 6 g/m$^2$ obtained by adding halogen compounds to 5 parts by weight of $TiO_2$, 0.3 part by weight of $MgB_4O_7$ and 100 parts by weight of MgO having a CAA value which differed from that of MgO used in another steel sheet in Example 4 as shown in Table 7, dried, and coiled. The steel sheet was then finish annealed (holding temperature during heating to finish annealing temperature being changed among steel sheets as shown in FIG. 2), and subjected to insulating coating treatment and heat flattening in the same manner as in Example 1 to give a final product. Table 8 shows the glass film properties and the magnetic properties of the steel sheet in the test.

TABLE 7

| | Properties of MgO used: CAA value (sec) | Properties of MgO used: specific surface area (g/m$^2$) | Halogen compounds and their amounts parts by weight*2) | Heat cycle of final finish annealing |
|---|---|---|---|---|
| Ex. 1 | 50 | 15 | mgF 0.03/$MnCl_2$ 0.03 | FIG. 2(A) |
| Ex. 2 | 120 | 15 | MgF 0.03/$MnCl_2$ 0.03 | FIG. 2(A) |
| Ex. 3 | 180 | 20 | MgF 0.03/$MnCl_2$ 0.03 | FIG. 2(A) |
| Ex. 4 | 240 | 15 | MgF 0.03/$MnCl_2$ 0.03 | FIG. 2(A) |
| Ex. 5 | 300 | 9 | MgF 0.03/$MnCl_2$ 0.03 | FIG. 2(A) |
| Ex. 6 | 50 | 20 | MgF 0.03/$MnCl_2$ 0.03 | FIG. 2(B) |
| Ex. 7 | 120 | 15 | MgF 0.03/$MnCl_2$ 0.03 | FIG. 2(B) |
| Ex. 8 | 300 | 9 | MgF 0.03/$MnCl_2$ 0.03 | FIG. 2(B) |
| Ex. 9 | 50 | 20 | MgF 0.03/$MnCl_2$ 0.03 | FIG. 2(C) |
| Ex. 10 | 120 | 15 | MgF 0.03/$MnCl_2$ 0.03 | FIG. 2(C) |
| Ex. 11 | 300 | 9 | MgF 0.03/$MnCl_2$ 0.03 | FIG. 2(C) |
| Comp. Ex. 1 | 120 | 15 | — | FIG. 2(A) |
| Comp. Ex. 2 | 120 | 15 | — | FIG. 2(B) |
| Comp. Ex. 3 | 120 | 15 | — | FIG. 2(C) |

Note:
Impurities of the base MgO were as follows: F: 0.0030, Cl: 0.002, Br: trace and I: trace.
*2: The addition amount is expressed in parts by weight in terms of halogens.

TABLE 8

| | State of glass film formation | Properties of glass film: Film tension (kg/(mm$^2$) | Properties of glass film: Adhesion* | Magnetic properties: $B_8$ (T) | Magnetic properties: $W_{17/50}$ (W/kg) |
|---|---|---|---|---|---|
| Ex. 1 | very thick, gas marks being formed slightly | 0.58 | ⊕ | 1.930 | 0.85 |
| Ex. 2 | Thick, uniform, lustrous and extremely good | 0.75 | ⊕ | 1.930 | 0.78 |
| Ex. 3 | Thick, uniform, lustrous and extremely good | 0.70 | ⊕ | 1.960 | 0.75 |
| Ex. 4 | uniform, lustrous and extremely good | 0.65 | ○ | 1.958 | 0.82 |
| Ex. 5 | uniform and dully lustrous | 0.48 | ○ | 1.941 | 0.86 |
| Ex. 6 | very thick gas marks being formed slightly | 0.62 | ⊕ | 1.935 | 0.85 |
| Ex. 7 | thick, uniform, lustrous and extremely good | 0.72 | ⊕ | 1.956 | 0.72 |
| Ex. 8 | uniform and dully lustrous | 0.51 | ○ | 1.932 | 0.84 |
| Ex. 9 | thick, gas mark-like uneven portions being formed to some degree | 0.56 | ⊕ | 1.926 | 0.86 |
| Ex. 10 | uniform and lustrous, good | 0.56 | ⊕ | 1.946 | 0.80 |
| Ex. 11 | uniform, thin to some degree, dully lustrous | 0.40 | Δ | 1.910 | 0.85 |
| Comp. Ex. 1 | very thin, metal surface being seen | 0.19 | X | 1.890 | 0.95 |
| Comp. Ex. 2 | very thin, metal surface being seen | 0.22 | X | 1.879 | 0.98 |

TABLE 8-continued

| | State of glass film formation | Properties of glass film: Film tension (kg/(mm$^2$)) | Properties of glass film: Adhesion* | Magnetic properties: $B_8$ (T) | Magnetic properties: $W_{17/50}$ (W/kg) |
|---|---|---|---|---|---|
| Comp. Ex. 3 | very thin, metal surface being seen | 0.26 | X | 1.895 | 0.94 |

As a result of the test, a steel sheet obtained by the use of an annealing separator of the present invention was always found to have good glass film properties and showed good magnetic properties compared with the comparative steel sheets. Moreover, a steel sheet of the invention obtained by conducting finish annealing of the heat cycle (A) or (B) where the steel sheet was held at a constant temperature during heating in finish annealing had a glass film stabilized and improved to some degree and showed extremely good magnetic properties compared with steel sheets obtained by conducting finish annealing with the heat cycle (C) where the steel sheets were not held at a constant temperature during heating in finish annealing. In addition, the influence of the CAA value of MgO is as described below. When MgO was highly active to have a CAA value of 50 sec, the glass film was likely to become nonuniform though thick, and the magnetic properties were also likely to be deteriorated to some degree. When MgO was inactive to have a CAA value of 300 sec, the glass film was likely to lower its thickness and lose its luster, and the magnetic properties were also deteriorated to some degree. When MgO had a CAA value of 120 to 240 sec, the steel sheet thus obtained had a uniform and lustrous glass film having a good tensile strength and a good adhesion, and showed extremely excellent magnetic properties. On the other hand, in comparative examples where no halogen compounds were added to annealing separators, the steel sheets thus obtained each had a glass film having poor properties and showed poor magnetic properties.

Example 5

Figure 3A:
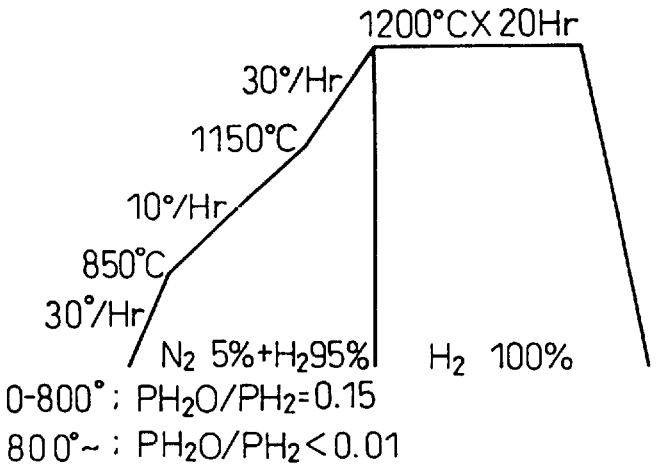
FIGS. 3A, 3B and 3C show the heat cycles and the atmosphere conditions of finish annealing in Example 5, and the heating rate changed under the conditions of (A), (B) and (C).
Figure 3B:
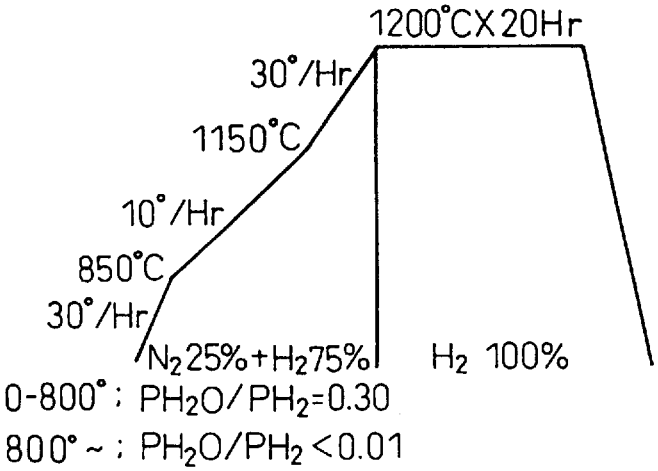
Figure 3C:
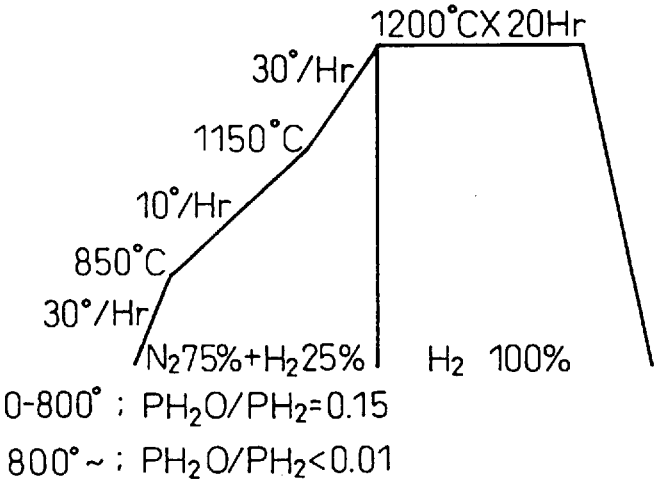

A nitrided coil treated in the same manner as in Example 4 was coated with a slurry of an annealing separator (dried amount of 6 g/m$^2$) obtained by adding halogen compounds shown in Table 9 to 5 parts by weight of $TiO_2$, 0.5 part by weight of $Li_2B_4O_7$ and 100 parts by weight of MgO which had a CAA value of 150 sec and a specific surface area of 18 m$^2$/g, and 85% of which had a particle size of up to 10 $\mu$m, differed from that of MgO used in another steel sheet in Example 4, and coiled. The steel sheet was then subjected to final finish annealing while the atmosphere gas was being changed during heating as shown in FIG. 3, and subjected to insulating coating treatment and heat flattening in the same manner as in Example 1 to give a final product. Table 10 shows the glass film properties and the magnetic properties of the steel sheet.

TABLE 9

| | Halogen compounds and addition amounts (parts by wt. as halogens) | | | | | Finish annealing condition: Annealing cycle | Finish annealing condition: $PH_2O/PH_2$ up to 800° C. |
|---|---|---|---|---|---|---|---|
| Ex. 1 | | | | $FeCl_2$ | 0.04 | FIG. 3 (A) | 0.15 |
| Ex. 2 | NaF | 0.04 | + | $FeCl_2$ | 0.04 | FIG. 3 (A) | 0.15 |
| Ex. 3 | MgF | 0.04 | + | $CoCl_2$ | 0.04 | FIG. 3 (A) | 0.15 |
| Comp. Ex. 1 | | | – | | | FIG. 3 (A) | 0.15 |
| Ex. 4 | | | | $FeCl_2$ | 0.04 | FIG. 3 (A) | 0.30 |
| Ex. 5 | NaF | 0.04 | + | $FeCl_2$ | 0.04 | FIG. 3 (A) | 0.30 |
| Ex. 6 | MgF | 0.04 | + | $CoCl_2$ | 0.04 | FIG. 3 (A) | 0.30 |
| Ex. 7 | | | | $FeCl_2$ | 0.04 | FIG. 3 (B) | 0.15 |
| Ex. 8 | NaF | 0.04 | + | $FeCl_2$ | 0.04 | FIG. 3 (B) | 0.15 |
| Ex. 9 | MgF | 0.04 | + | $CoCl_2$ | 0.04 | FIG. 3 (B) | 0.15 |
| Ex. 10 | | | | $FeCl_2$ | 0.04 | FIG. 3 (C) | 0.15 |
| Ex. 11 | NaF | 0.04 | + | $FeCl_2$ | 0.04 | FIG. 3 (C) | 0.15 |
| Ex. 12 | MgF | 0.04 | + | $CoCl_2$ | 0.04 | FIG. 3 (C) | 0.15 |
| Comp. Ex. 2 | | | – | | | FIG. 3 (C) | 0.15 |

Note:
Impurities in base MgO was as follows: F: 0.0030, Cl: 0.002, BR: trace, and I: trace.

TABLE 10

| | State of glass film formation | Properties of glass film: Film tension (kg/mm$^2$) | Properties of glass film: Adhesion* | Magnetic properties: $B_8$ (T) | Magnetic properties: $W_{17/50}$ (W/kg) |
|---|---|---|---|---|---|
| Ex. 1 | uniform, thick and lustrous, good | 0.58 | ⊕ | 1.945 | 0.79 |
| Ex. 2 | uniform, thick and lustrous, very good | 0.68 | ⊕ | 1.955 | 0.74 |
| Ex. 3 | uniform, thick and lustrous, very good | 0.70 | ⊕ | 1.948 | 0.76 |
| Comp. Ex. 1 | very thin, many uneven portions | 0.15 | X | 1.750 | — |
| Ex. 4 | slight scale-like uneven portions being formed though thick | 0.48 | Δ | 1.930 | 0.84 |
| Ex. 5 | scale-like, gas mark-like uneven portions being formed, though thick | 0.49 | Δ | 1.928 | 0.84 |
| Ex. 6 | scale-like, gas mark-like uneven portions being formed, though thick | 0.52 | Δ | 1.932 | 0.83 |
| Ex. 7 | uniform, thick and lustrous, good | 0.60 | ⊕ | 1.950 | 0.79 |
| Ex. 8 | uniform, thick and lustrous, very good | 0.66 | ⊕ | 1.945 | 0.73 |
| Ex. 9 | uniform, thick and lustrous, very good | 0.75 | ⊕ | 1.948 | 0.77 |
| Ex. 10 | scale-like gas mark-like uneven portions being formed, though thick | 0.55 | ○ | 1.933 | 0.84 |
| Ex. 11 | somewhat many scale-like, gas mark-like uneven portions | 0.58 | ○ | 1.929 | 0.86 |
| Ex. 12 | somewhat many scale-like, gas mark-like uneven portions | 0.52 | ○ | 1.935 | 0.83 |
| Comp. Ex. 2 | very thin, scale-like defects existing here and there | 0.20 | X | 1.899 | 0.93 |

As a result of the test, it is found that when the annealing separators of the present invention were used, or when the heating atmosphere gas for finish annealing contained at least 70% of $H_2$ and had a $PH_2O/PH_2$ ratio, a steel sheet thus obtained had an extremely uniform and good glass film and excellent magnetic properties. However, when the atmosphere gas contained 75% of $N_2$ or had a $PH_2O/PH_2$ ratio of 0.30, scale-like defects or gas mark-like defects always existed here and there on the glass film, and the adhesion was poor. Moreover, the magnetic properties were poor to some degree. On the other hand, in comparative examples where halogen compounds were not added as an annealing separator, the glass film properties and the magnetic properties became considerably poor compared with those of the steel sheets of the present invention.

INDUSTRIAL AVAILABILITY

According to the present invention, an extremely excellent glass film can be obtained, and the magnetic properties can be improved by setting the content of halogen compounds at a given amount in the course of producing MgO and preparing a slurry of MgO. Addition of an alkali metal and/or alkaline earth metal to the halogen compounds in combination at this time further heightens the effects.

Furthermore, the glass film and the magnetic properties are further improved by optimizing the heat cycle and the atmosphere conditions in finish annealing.

We claim:

1. A process for producing grain-oriented electrical steel sheet comprising:

coating a decarburization annealed electrical steel sheet with an annealing separator;

then finish annealing the annealing separator coated electrical steel sheet;

then coating the finish annealed electrical steel sheet with an insulating coating agent;

then baking the insulating coating agent coated electrical steel sheet;

said process further comprising, said annealing separator agent coated onto said decarburization annealed electrical steel sheet comprising a slurry containing MgO wherein 100 parts by weight MgO added to said slurry contains F in an amount of at least 0.005 parts by weight, and total halogen in the form of F, Cl, Br or I in a total amount of 0.015 to 0.120 parts by weight in terms of F, Cl, Br or I.

2. A process according to claim 1 wherein 100 parts by weight MgO added to said slurry contains chlorides of at least one of H, Li, Ba, V, Cr, Mo, Mn, Fe, Co, Ni, Cu, Ag, Zn, Cd, Al, Sn, Bi, and O in an amount of 0.015 to 0.120 parts by weight in terms of Cl.

3. A process according to claim 1 wherein 100 parts by weight MgO added to said slurry contains at least one of alkali metal compounds and alkaline earth metal compounds, excluding halogen compounds, in a amount of 0.010 to 0.50 parts by weight.

4. A process according to claim 1 wherein at least one of a fluoride and a chloride of an element selected from the group consisting of Fe, Co, Mn, Cu and Ni is present representing at least 50% of total halogen present in terms of said at least one of fluoride and chloride.

5. A process according to claim 1 wherein said MgO has a specific surface area of at least 10 $m^2/g$, a CAA value of 40 to 250 sec, and at least 50% of MgO has a particle size of up to 10 $\mu$m.

6. A process according to claim 1 wherein an oxide film on the electrical steel sheet after decarburization annealing contains (Fe, Mn)–0 in an amount of 0.015 to 0.30 $g/m^2$.

7. A according to claim 1 wherein said electrical steel sheet is finish annealed by heating at an average heating rate of up to 12° C./hr during raising finish annealing temperature from 850° to 1,150° C.

8. A process according to claim 1 wherein during finish annealing said electrical steel sheet is held for 5 to 20 hours in a temperature range from 850° to 1,150° C. during temperature raising of the finish annealing.

9. A process according to claim 1 wherein during finish annealing said electrical steel sheet is annealed in an atmosphere gas having a $PH_2O/PH_2$ ratio of up to 0.25 during temperature raising up to 800° C.

10. A process according to claim 1 wherein during finish annealing said electrical steel sheet is annealed in an atmosphere gas which is a mixture of $N_2$ and $H_2$ containing at least 30% $H_2$ during temperature raising up to 800° C.

* * * * *